United States Patent [19]

Matsunami

[11] Patent Number: 4,578,925

[45] Date of Patent: Apr. 1, 1986

[54] METHOD OF AND APPARATUS FOR PACKAGING A WALL OF A BORE

[75] Inventor: Akira Matsunami, Kimitsu, Japan

[73] Assignee: Nippon Steel Corporation, Japan

[21] Appl. No.: 698,477

[22] Filed: Feb. 5, 1985

[30] Foreign Application Priority Data

Feb. 7, 1984 [JP] Japan ..... 59-19342
Apr. 12, 1984 [JP] Japan ..... 59-71881

[51] Int. Cl.[4] ..... B65B 25/24
[52] U.S. Cl. ..... 53/409; 53/204; 53/581; 242/55.53; 156/74
[58] Field of Search ..... 53/409, 204, 581; 493/304; 156/74, 294; 242/55.53, 55

[56] References Cited

U.S. PATENT DOCUMENTS 2,859,151 11/1958 Vsab ..... 156/74
3,788,916 1/1974 Gadelius ..... 156/74

FOREIGN PATENT DOCUMENTS 70690 6/1977 Japan ..... 53/204

*Primary Examiner*—John Sipos
*Attorney, Agent, or Firm*—Pollock, Vande Sande & Priddy

[57] ABSTRACT

A method of and an apparatus for attaching a sheet of packaging material to a wall of a bore of a coil of metal wherein the sheet of packaging material is fed into and discharged from a mandrel case and automatically attached to the wall of the bore of the coil by the pinch rollers contacting the wall and biasing forces of swing rollers supported on the mandrel case.

7 Claims, 13 Drawing Figures

METHOD OF AND APPARATUS FOR PACKAGING A WALL OF A BORE

BACKGROUND OF THE INVENTION

This invention relates to methods of and apparatus for packaging a wall of a bore, and more particularly it is concerned with a method of and an apparatus suitable for packaging a wall of a bore of a coil of metal.

Strips of metal rolled by a hot strip mill or cold strip mill have been known to be coiled by a coiler into a coil which is packaged. In packaging a coil of strips of metal, proposals have been made to use a method wherein an inner periphery of the coil is covered with a sheet of packaging material, a sheet of packaging material of large width is wound on an outer periphery of the coil, and left and right edge portions of the sheet of packaging material are folded to cover side edges of the coil, as disclosed in Japanese Laid-Open Patent Application No. 68315/82, for example.

It has hitherto been usual practice to manually attach a sheet of packaging material to the inner periphery of the coil. This operation has been time-consuming and caused a great deal of fatigue to the operator who has to attach the sheet to the inner periphery of the coil by leaning forwardly, involving the risk of the operator suffering injury.

SUMMARY OF THE INVENTION

This invention has been developed for the purpose of obviating the aforesaid problem of the prior art. Accordingly, the invention has as one of its objects the provision of a method of and an apparatus for automatically packaging an inner periphery of a coil of strips of metal, thereby automating the operation of packaging coils and saving labor.

Another object of the invention is to provide a method of and an apparatus for automatically packaging an inner periphery of a cylindrical article which enable pakaging of the inner periphery to be positively effected even if the bore is deformed and not truly circular.

Still another object of the invention is to provide a method of and an apparatus for packaging a bore of a cylindrical article which enable a sheet of packaging material to readily and positively adhere to an inner periphery of the cylindrical article without the material being wasted.

According to the invention, there is provided a method of attaching a sheet of packaging material to a wall of a bore of a coil of metal comprising the steps of feeding a sheet of packaging material in a suitable length from a roll of a web of packaging material into a mandrel by means of pinch rollers, inserting the mandrel in the bore of the coil while holding a distal end of the sheet of packaging material by the pinch rollers, commencing rotation of the mandrel by forcing the pinch rollers against the wall of the bore of the coil while the distal end of the sheet of packaging material is being held by the pinch rollers, and attaching the sheet of packaging material to the wall of the bore of the coil by the pinch rollers contacting the wall of the bore of the coil and the biasing forces of swing rollers while the mandrel is being rotated.

Additional and other objects, features and advantages of the invention will become apparent from the description set forth hereinafter when considered in conjunction with the accompanying drawings.

PREFERRED EMBODIMENTS OF THE INVENTION

Preferred embodiments of the invention will now be described by referring to the accompanying drawings.

Figure 1:
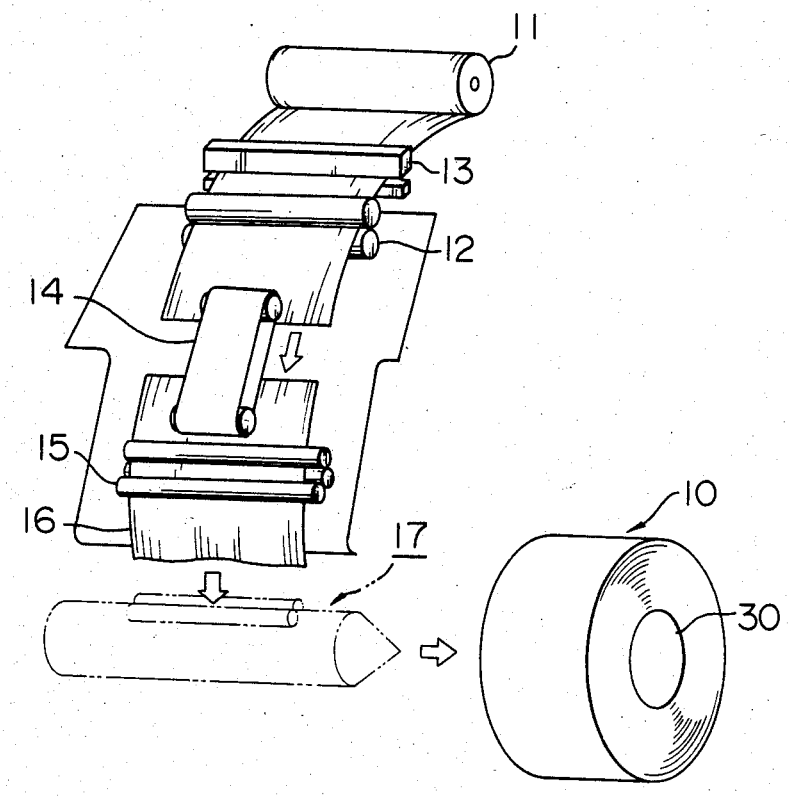
FIG. 1 is a schematic view of an apparatus suitable for carrying the method according to the invention into practice, showing the manner in which a packaging operation is performed.

FIG. 1 shows the apparatus comprising one embodiment of the invention suitable for carrying the method according to the invention into practice, showing the manner in which the packaging operation is performed. A sheet of packaging material (hereinafter inner periphery packaging sheet) 16 payed out of a roll 11 of a web of packaging material is held by feed rollers 12 and cut by a shear 13 in a suitable length. The inner periphery packaging sheet 16 thus severed from the roll 11 of a web of paper is fed by a feed conveyor 14 and leveller rolls 15 into a mandrel 17.

The mandrel 17 having the inner periphery packaging sheet 16 fed thereinto is inserted in a bore 30 of a coil 10, so as to attach the inner periphery packaging sheet 16 to a wall of the bore 30. The coil 10 has a width in the range between 500 and 2180 mm. The mandrel 17 has a length which corresponds to the width of the coil 10. The bore 30 of the coil 10 usually has a diameter in the range between 20 and 30 in. Thus, the inner periphery packaging sheet 16 has a size which matches the size of the bore 30 of the coil 10.

Figure 2:
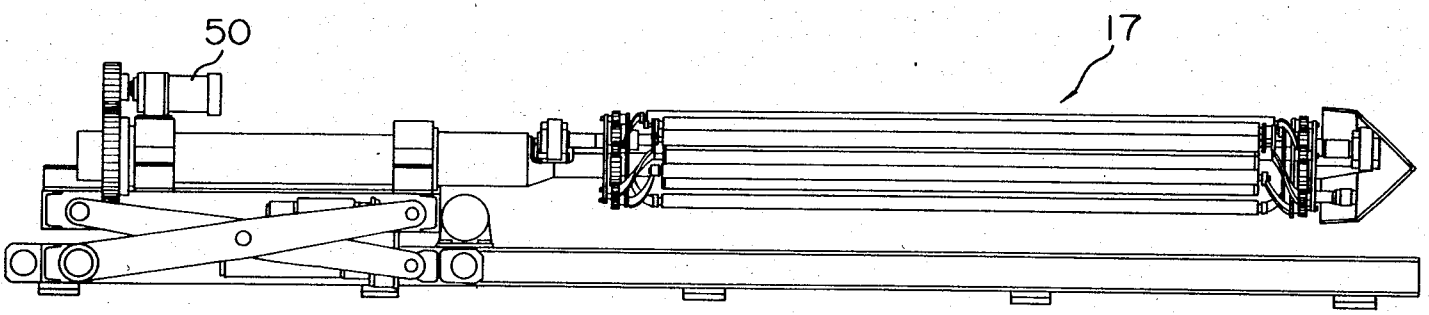
FIG. 2 is a side view of the mandrel of the apparatus shown in FIG. 1.
Figure 3:
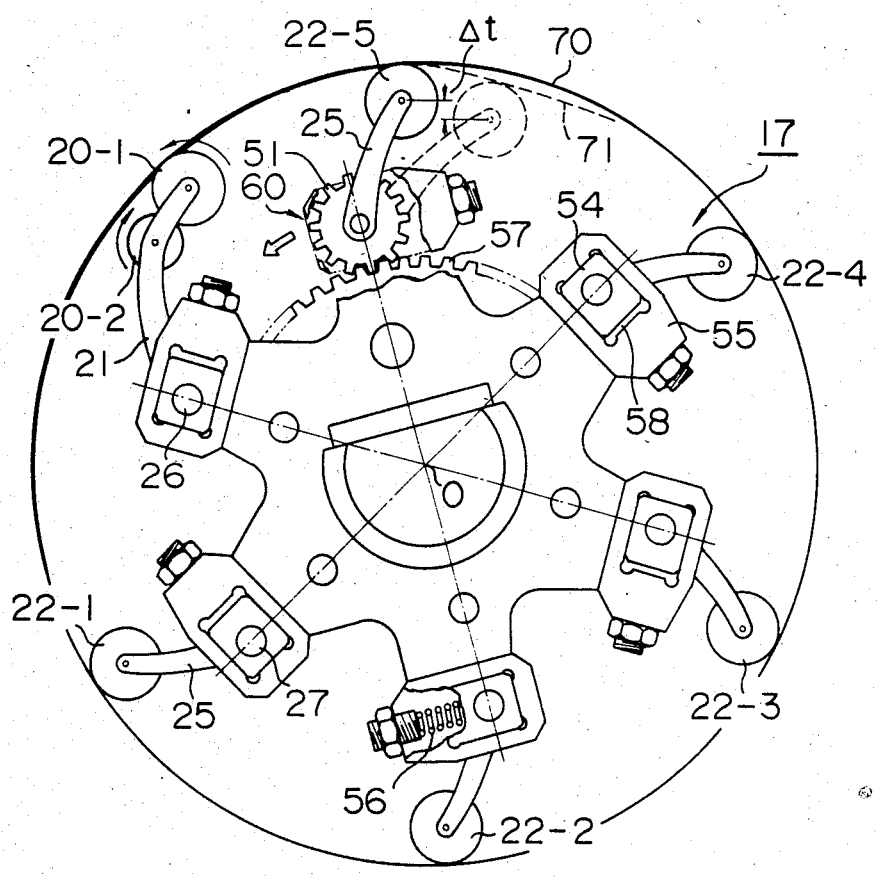
FIG. 3 is a fragmentary sectional view of the essential portions of the mandrel of one constructional form according to the invention.
Figure 4:
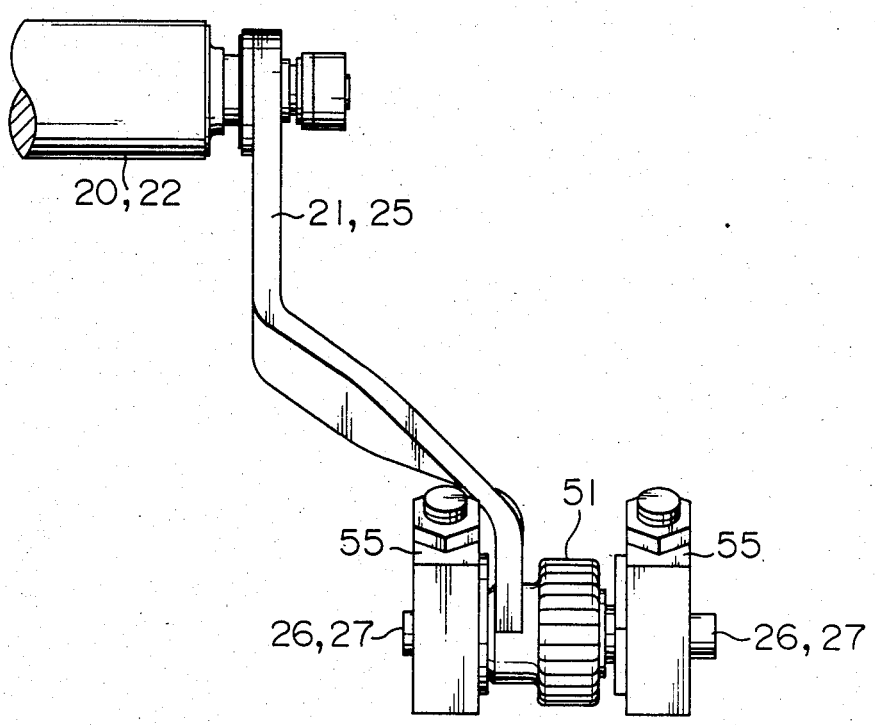
FIG. 4 is a view, on an enlarged scale, of one of the arms shown in FIG. 3.
Figure 5A:
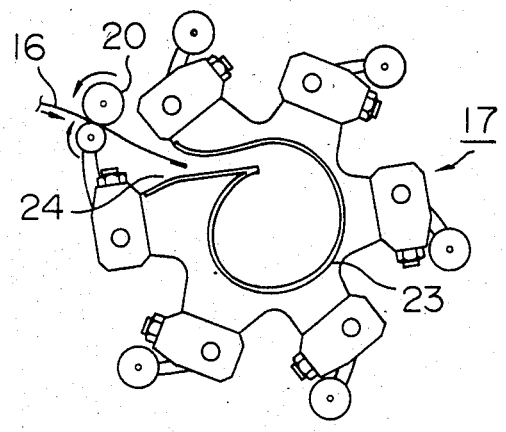
FIGS. 5(*a*)–5(*g*) are views in explanation of the operation of one embodiment of the invention.
Figure 5B:
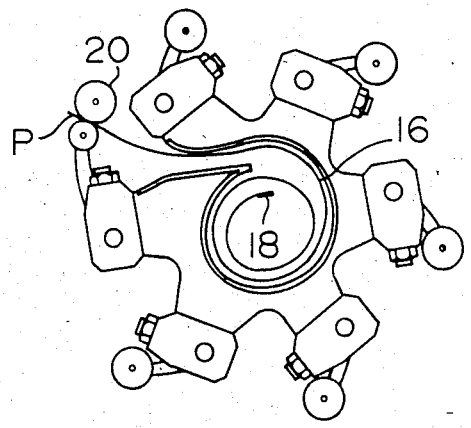
Figure 5C:
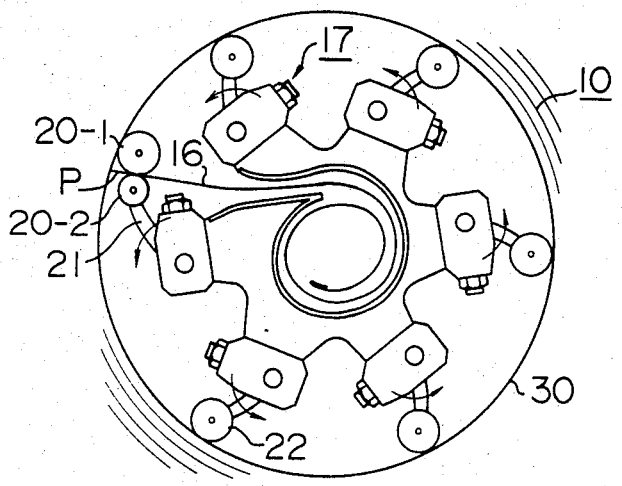
Figure 5D:
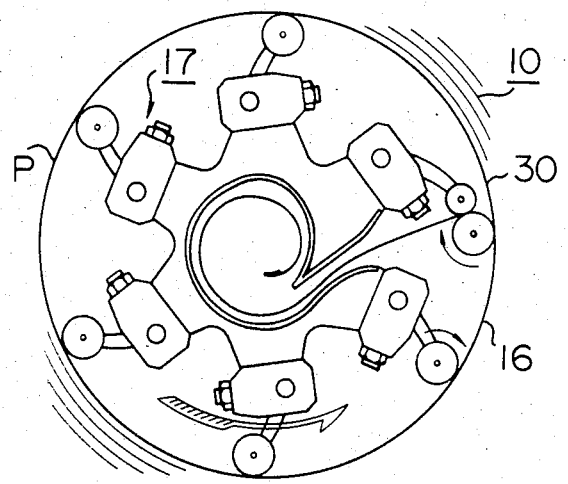
Figure 5E:
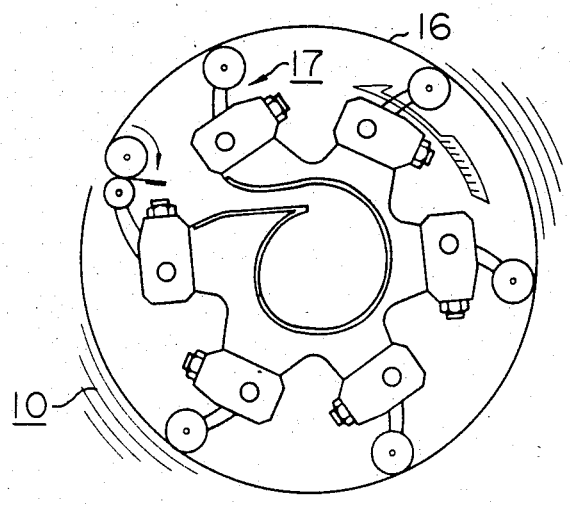
Figure 5F:
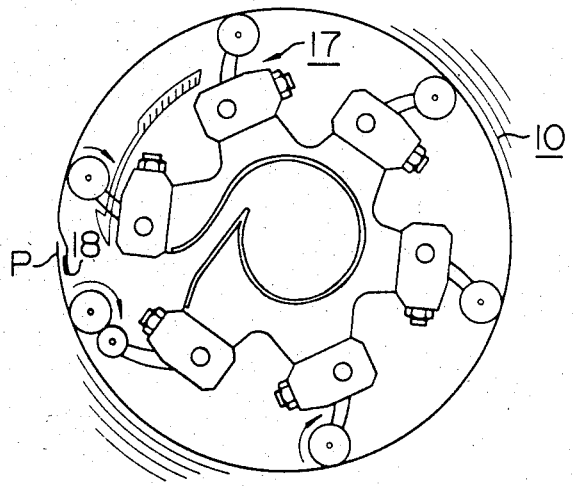
Figure 5G:
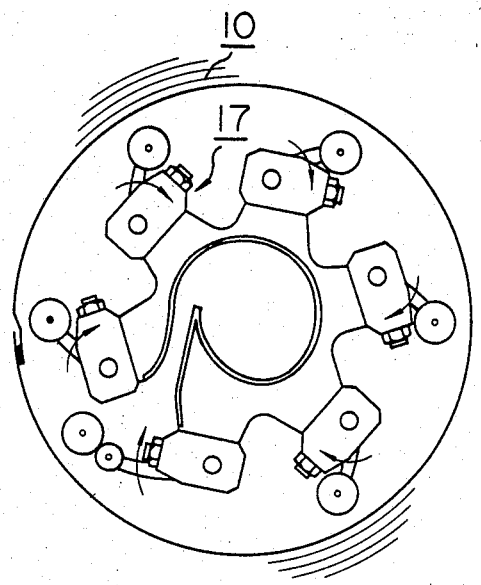

FIG. 2 shows in a side view the mandrel 17, and FIG. 3 is a fragmentary sectional view of the mandrel 17, showing its essential portions. A mandrel case 23 is substantially cylindrical in configuration and has a length which is sufficiently great to hold the inner periphery packaging sheet 16 therein. The mandrel case 23 is formed at one portion thereof with an opening 24 for receiving the inner periphery packaging sheet 16 and discharging same therethrough. A plurality of arms 25 each supporting a roller 22 at one end and supported by a shaft 27 at an opposite end for swinging movement are mounted to the periphery of either end of the mandrel case 23. An arm 21 supporting pinch rollers 20-1 and 20-2 at one end portion is supported at an opposite end by a shaft 26 for swinging movement in a position facing the inner periphery packaging sheet receiving and discharging opening 24. The pinch rollers 20-1 and 20-2 differ from each other in diameter, and means is provided for driving the pinch rollers 20-1 and 20-2 to rotate in directions indicated by arrows.

The plurality of swing rollers 22-1 to 22-5 (five swing rollers are shown but the number may be increased or decreased as desired) supported by the swing arms 25 are driven for swinging movement by well known drive means, not shown, built thereinto. Thus, as the swing arms 25 move in swinging movement about the shafts 27, the swing rollers 22-1 to 22-5 are spread out and withdrawn, and when they are spread out, the rollers 20-1 to 22-5 are brought into contact with a wall of the bore 30 to facilitate attaching of the inner periphery sheet 16 to the wall of the bore 30. The pinch rollers 20-1 and 20-2 each have a coat of fluorine resin, polyethylene, etc., at its surface to avoid adhesion of the inner periphery sheet 16 to the rollers 20-1 and 20-2. The mandrel case 23 also has a coat of fluorine resin, polyethylene, etc.

Like the swing rollers 22, the pinch rollers 20 are moved for swinging movement, and drive means 50 is provided for rotating the mandrel 17 as a whole (see FIG. 2). The mandrel 17 is carried by a truck, not shown, to facilitate insertion into the bore 30 of the coil 10.

The arms 21 and 25 supporting the rollers 20 and 22 are each firmly secured, as by welding, to a swing gear 51 having a slider 54 coaxially connected thereto. The slider 54 is loosely fitted in a cutout 58 of a holder 55 mounted on a plate concentrically located with a center gear 57 at a point 0 for sliding movement. Mounted in the cutout 58 of the holder 55 is a spring 56 which biases the slider 54 in one direction.

The swing gear 51 of a positioning member 60 is mounted such that it meshes with the center gear 57. A plurality of positioning members 60 (six in number in the embodiment shown) are arranged to cooperate with the center gear 57.

As the holder 55 is rotated in the direction of an arrow, the arm 21, 25 is brought to an upright position as indicated by an arrow by the biasing force of the spring 56. If an end portion 70 of the coil 10 is displaced as indicated by a broken line 71 and a force tending to suppress the roll 20, 22 is exerted thereon, then the slider 54 moves in sliding movement in the cutout 58 against the biasing force of the spring 56, so that the positioning member 60 is moved from a solid line position to a broken line position by covering a distance $\Delta t$. The plurality of positioning members 60 are located to cooperate with the center gear 57 through the holder 55. Thus, when one of the holder 55 is rotated and a load is applied by the end portion 71 of the coil 10 to the positioning member 60, the slider 54 moves in sliding movement in the cutout 58 of the slider 54 as described hereinabove, so that the swing gear 51 moves along the center gear 57 while meshing therewith to a position indicated by broken lines. Meanwhile, the rest of the positioning members 60 remain in a stable condition under the load applied by the coil 10.

The method of attaching the inner periphery packaging sheet 16 to the wall of the bore 30 of the coil 10 according to the invention will now be described.

FIGS. 5(*a*)–5(*g*) are views in explanation of the method according to the invention. As the pinch rollers 20 are driven, the inner periphery packaging sheet 16 is fed through the inner periphery packaging sheet receiving and discharging opening 24 into the mandrel case 23 [FIG. 5(*a*)]. A force driving the pinch rollers 20 is removed immediately before the distal end P of the inner periphery packaging sheet 16 is released from the pinch rollers 20 [FIG. 5(*b*)]. Thus, the inner periphery packaging sheet 16 is held in the mandrel case 23 while the distal end P thereof is being held by the pinch rollers 20. The inner periphery packaging sheet 16 which has an adhesive agent 18 applied to one side of a leading end portion thereof is fed into the mandrel case 23 in such a manner that the one side having the adhesive agent applied thereto faces inwardly.

Then, the mandrel 17 is moved and inserted into the bore 30 of the coil 10. In performing this operation, a track, not shown, carrying the mandrel 17 may be positioned beforehand with respect to the coil 10. After the mandrel 17 is set within the bore 30 or the coil 10, the arms 21 and 25 are moved in swinging movement to spread out the pinch rollers 20-1 and 20-2 and the swing rollers 22, to bring them into pressing contact with the wall of the bore 30 [FIG. 5(*c*)].

Although the distal end P of the inner periphery packaging sheet 16 is held between the pinch rollers 20, the pinch rollers 20-1 and 20-2 which differ from each other in diameter are brought into contact with the wall of the bore 30 as the arm 21 moves in swinging movement to a substantially upright position. Then, the pinch rollers 20-1 and 20-2 are released from the drive means and allowed to rotate freely along the wall of the bore 30. Thereafter, the mandrel 17 is rotated in the direction of an arrow shown in FIG. 5(*d*). This causes the pinch roller 20-1 to rotate along the wall of the bore 30 of the coil 10, thereby releasing the distal end P of the inner periphery packaging sheet 16 from the pinch rollers 20-1 and 20-2 and holding the inner periphery packaging sheet 16 between the pinch roller 20-1 and the wall of the bore 30.

Further rotation of the mandrel 17 allows the inner periphery packaging sheet 16 to be attached to the wall of the bore 30. At this time, the distal end P of the inner periphery packaging sheet 16 is located in a position in which the rotation of the mandrel 17 is commenced and successively pressed by the plurality of swing rollers 22-1 to 22-5 [FIGS. 5(*d*) and 5(*e*)].

The adhesive agent 18 is applied to the leading end portion of the inner periphery packaging sheet 17 to which a trailing end portion thereof is placed in overlapping relation. Thus, the distal end P of the inner periphery packaging sheet 16 is forced against the adhesive agent 18 on the leading end portion of the sheet 16, thereby finishing the operation of attaching the inner periphery packaging sheet 16 to the wall of the bore 30 of the coil 10 [FIG. 5(*f*)].

Upon completion of the operation of attaching the inner periphery packaging sheet 16 to the wall of the bore 30, the swinging movement of each of the swing rollers 22-1 to 22-5 and pinch rollers 20-1 supported by the arms 21 and 25 respectively is stopped, and the arms 21 and 25 are brought to a substantially lying position [FIG. 5(*g*)], before the mandrel 17 is withdrawn from the bore 30 and restored to its original position.

Figure 6:
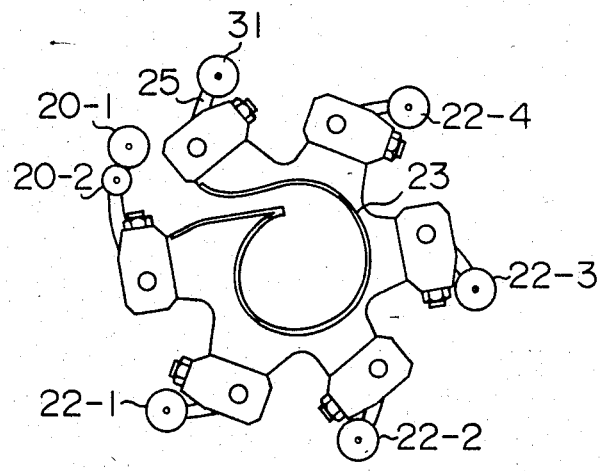
FIG. 6 is a sectional schematic view of the mandrel of another constructional form according to the invention suitable for carrying the method according to the invention into practice.

FIG. 6 shows the mandrel 17 of another constructional form in which a heater roller 31 having a built-in heating source, not shown is supported by the arm 25 for swinging movement like the swing rollers 22 (which is four in number in this embodiment). Thus, when the heating roller 31 is spread out by the swinging movement of the arm 25, it forces the inner periphery packaging sheet 16 against the wall of the bore 30 of the coil 10 in the same manner as the swing rollers 22.

In this embodiment, the inner periphery packaging sheet 16 has a heat sensitive advesive agent applied to one side of its leading end portion. Other parts similar to those shown in FIGS. 1 to 5 are designated by like reference characters and their description is omitted.

In this embodiment, the mandrel 17 is set in the bore 30 of the coil 10 while the tail end of the inner periphery packaging sheet 16 is held between the pinch rollers 20-1 and 20-2. Then, the pinch roller 20-1, swing rollers 22-1 to 22-4 and heater roller 31 are spread out and the inner periphery packaging sheet 16 is attached to the wall of the bore 30 in the same manner as described by referring to FIGS. 5(*d*) and 5(*e*).

Then, the leading end portion of the inner periphery packaging sheet having the coat of heat sensitive adhesive agent is superposed on a trailing end portion thereof in overlapping relation, and the overlapping portions of the sheet 16 are forced by the pinch roller 20-1 and swing rollers 22-1 to 22-4 against the wall of the bore 30 while a current is passed to the heater roller 31 to cause the overlapping portions of the sheet 16 to adhere to each other.

Figure 7:
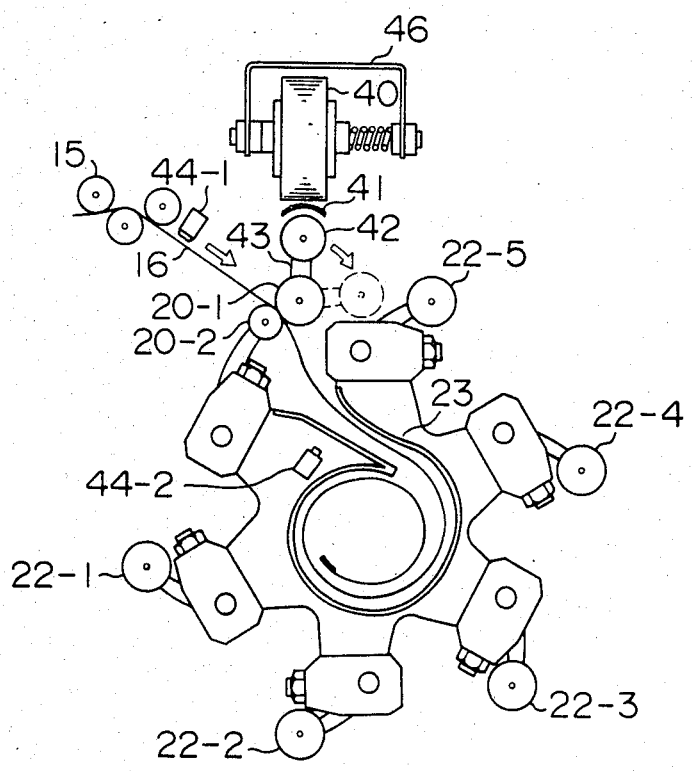
FIG. 7 is a sectional schematic view of the mandrel of still another constructional form according to the invention suitable for carrying the method according to the invention into practice.

FIG. 7 shows the mandrel of still another constructional form in which the pinch roller 20-1 supports through an arm 43 a vacuum roller 42 for rotation. An adhesive tape cartridge 40 supported on a support 46 is disposed in a position corresponding to the position of the vacuum roller (hereinafter taping roller) 42. The numeral 44 designates an inner periphery packaging sheet distal end sensor. Other parts similar to those shown in FIGS. 2–5 are designated by like reference characters and their description is omitted.

In this embodiment, the inner periphery packaging sheet 16 fed from the roll 11 of the web of packaging material is supplied via the levellers 15 to the pinch rollers 20 and fed into the mandrel case 23 as the pinch rollers 20 are rotated. When the distal end of the inner periphery packaging sheet 16 is sensed by the sensor 44, the driving the pinch rollers 20 is terminated while distal end P of the sheet 16 is being held by the pinch rollers 20.

Thereafter, the adhesive tape 41 is drawn by suction to the taping roller 42 in such a manner that the surface of the adhesive tape 41 having a coat of adhesive agent applied thereto faces outwardly, and the arm 43 is pivotally moved toward the mandrel case 23 to move the taping roller 42 to a broken line position in which it is disposed inwardly of the circumference of an imaginary circle formed by the swing rollers 22-1 to 22-5 disposed in a withdrawn position.

Then, as shown in FIG. 3, the inner periphery packaging sheet 16 is attached to the wall of the bore 30 of the coil 10. In attaching the inner periphery packaging sheet 16 to the wall of the bore 30, a point of the inner periphery packaging sheet 16 at which the sheet 16 is released from the mandrel case 23 is sensed by an end sensor 42-2, and this point is used as a starting point for determing a terminal position of the sheet 16 on the wall of the bore 30. Thereafter, the arm 43 of the taping roller 42 is pivotally moved away from the mandrel case 23 to apply the tape 41 to an overlapping portion of the inner periphery packaging sheet 16.

While the invention has been described as being operative to feed the inner periphery packaging sheet into the mandrel case and attach the inner periphery packaging sheet to the wall of the bore of a coil by utilizing the biasing force of the pinch roller, it is to be understood that the invention is not limited to the specific forms of the embodiments shown and described hereinabove and that many changes and modifications may be made therein. For example, to help the pinch roller and swing rollers rotate, a drive force of a low magnitude may be exerted on them while they are maintained in contact with the wall of the bore of the coil, and a pocket for receiving an inner periphery packaging sheet may be provided to an outer periphery of the mandrel without departing from the scope of the invention.

According to the invention, the inner periphery packaging sheet cut beforehand in a predetermined length is fed into the mandrel case by means of the pinch rollers while the distal end of the inner periphery packaging sheet is held between the pinch rollers, and the inner periphery packaging sheet is attached to the wall of the bore of the coil by the biasing force of the pinch roller after driving the pinch rollers is terminated. This allows packaging the wall of the bore of the coil to be effected automatically without requiring manual attention.

In the invention, the pinch rollers and swing rollers are spread out and withdrawn by the arms that move in swinging movement. This allows the operation of attaching an inner periphery packaging sheet to the wall of the bore of a coil to be performed without any trouble even if there are variations in the diameter of the bore of the coil. When the inner periphery packaging sheet is fed into the mandrel case, there is no risk of the inner periphery packaging sheet being wrinkled or broken even if the end portions of the coil are deformed or convolutions of the coil have become loosened.

The feature of the invention noted hereinabove enables local irregularities in the wall of the bore of the coil to be accommodated, enabling the operation of packaging the wall of the bore of the coil to be automatically performed by suitably positioning the mandrel by the rollers spread out and withdrawn by the swinging movement of the arms. However, the invention is not limited to packaging the wall of the bore of the coil performed by virtue of the spreading out and withdrawing of the rollers, and the invention enables a load applied to a coil in a horizontal condition to be uniformly borne, even if there are local irregularities in the bore.

What is claimed is:

1. A method of attaching a sheet of packaging material to a wall of a bore of a coil of metal comprising the steps of:

feeding a sheet of packaging material in a suitable length from a roll of a web of packaging material into a mandrel by means of pinch rollers movably mounted on the periphery of the mandrel, said mandrel further supporting on its periphery a plurality of outwardly biased swing rollers;

inserting the mandrel in the bore of the coil while holding a distal end of the sheet of packaging material by the pinch rollers;

forcing the pinch rollers outwardly against the wall of the bore of the coil while the distal end of the sheet of packaging material is being held by the pinch rollers;

commencing rotation of the mandrel relative the coil while the pinch rollers hold the material and attaching the sheet of packaging material to the wall of the bore of the coil as the pinch rollers and swing rollers contact the wall of the bore of the coil while the mandrel is being rotated to thereby disperse said material from the mandrel and press it into the inside wall of the bore.

2. An apparatus for attaching a sheet of packaging material to a wall of a bore of a coil of metal comprising:

a mandrel case for receiving a sheet of packaging material fed thereinto and discharging the sheet of packaging material therefrom;

an arm pivotably connected at one end to the periphery of the mandrel case and supporting for rotation pinch rollers at an opposite end which hold an end of said sheet material;

a plurality of arms each pivotably connected at one end to the periphery of the mandrel case and supporting for rotation a swing roller at an opposite end;

drive means for outwardly moving the pinch rollers and swing rollers into contact with the walls of the bore to force the sheet of packaging material against the wall of the bore of the coil after the sheet of packaging material is discharged from the mandrel case and for rotating the mandrel case and rollers to discharge said material from the mandrel and to attach the sheet of packaging material to the wall of the bore of the coil.

3. An apparatus for attaching a sheet of packaging material to a wall of a bore of a coil of metal as claimed in claim 2, wherein said sheet of packaging material has a coat of adhesive agent applied only to one side of a leading end portion thereof.

4. An apparatus for attaching a sheet of packaging material to a wall of a bore of a coil of metal as claimed in claim 3, wherein said adhesive agent is of a heat sensitive type.

5. An apparatus for attaching a sheet of packaging material to a wall of a bore of a coil of metal as claimed in claim 2, further comprising a taping roller supported by an arm connected to the arm for supporting the pinch rollers, said taping roller being operative to attach an adhesive tape to overlapping portions of the sheet of packaging material.

6. An apparatus for attaching a sheet of packaging material to a wall of a bore of a coil of metal as claimed in claim 2, further comprising automatic positioning means comprising a plurality of positioning members located along a center gear connected to a plate, said positioning members each comprising a swing gear firmly secured to one of said arms supporting the roller, a holder formed with a cutout, said holder being connected to said swing gear, a slider coaxial with said swing gear and slidably fitted in said cutout, and a spring mounted in the cutout for biasing said slider in one direction.

7. An apparatus for attaching a sheet of packaging material to a wall of a bore of a coil of metal as claimed in claim 6, wherein said plate is concentric with said center gear.

* * * * *